United States Patent [19]

Reiner

[11] 4,267,770

[45] May 19, 1981

[54] CHARGE FEEDING AND SLEEVE VALVE CONSTRUCTIONS FOR AUTOMATIC PLATEN PRESS

[76] Inventor: Ralph E. Reiner, 6474 Chestnut La., Orchard Park, N.Y. 14127

[21] Appl. No.: 81,139

[22] Filed: Oct. 2, 1979

Related U.S. Application Data

[63] Continuation-in-part of Ser. No. 36,062, May 4, 1979.

[51] Int. Cl.[3] ..... B30B 9/06

[52] U.S. Cl. ..... 100/122; 100/116; 100/196; 222/235; 222/412

[58] Field of Search ..... 100/116, 122, 123, 124, 100/126, 196, 194, 197, 198; 222/235, 412, 450

[56] References Cited

U.S. PATENT DOCUMENTS

| | | | |
|---|---|---|---|
| 729,807 | 6/1903 | Stoveken | 100/123 X |
| 1,912,988 | 6/1933 | Masters | 222/235 X |
| 2,576,941 | 12/1951 | Ingalls | 222/235 X |

FOREIGN PATENT DOCUMENTS

| | | | |
|---|---|---|---|
| 8517 | 5/1933 | Australia | 222/412 |
| 147597 | 7/1952 | Australia | 222/412 |
| 912843 | 5/1946 | France | 100/197 |

*Primary Examiner*—Peter Feldman

*Attorney, Agent, or Firm*—Bean, Kauffman & Bean

[57] ABSTRACT

A platen press having a vertically extending sleeve of filter cloth arranged intermediate a pair of vertically disposed cooperating press platens supported for relative horizontal movement for squeezing a charge of fruit contained within the sleeve, is provided with an improved hopper supply assembly for effecting batchwise charging of the sleeve with fruit to be pressed and an improved upper valve assembly cooperating with a lower valve assembly for clamping off upper and lower ends of the sleeve to retain the charge of fruit therewithin during a pressing operation.

10 Claims, 8 Drawing Figures

130'
132'
12
130
132
4
142
174
136b
144
124'
122'
124
140
200b
3
180'
136a
176
200a
186
146
300b
4
184'
122
180
10
32
28
16b
300a
184
210
56b
178
170a
224
20'
324
3
310
56a'
26
16c'
34
40
52
18
16c
16d
16a
32
56a
20
16
78
90a
32
26'
52'
40'
24'
16h'
22
84
16f
46
82a
16h
90a'
24
16e
46'
80a'
80a
16d
14

Fig. 4.
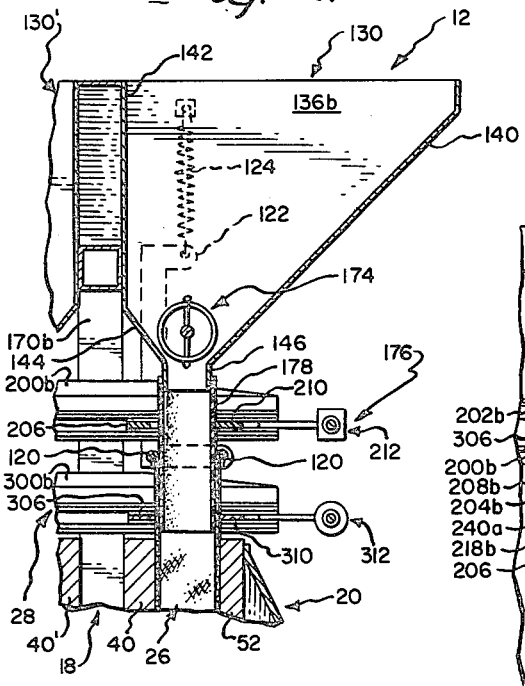
Fig. 3.
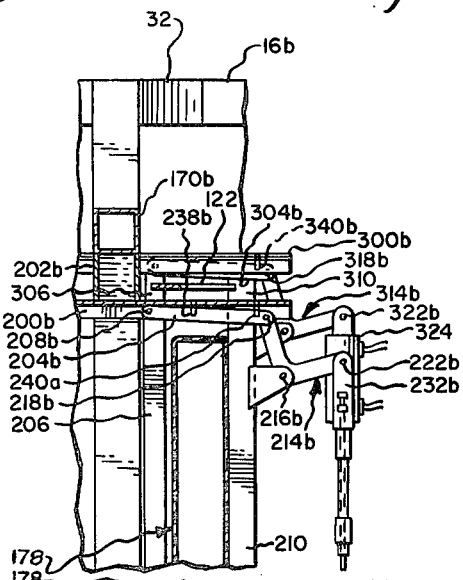
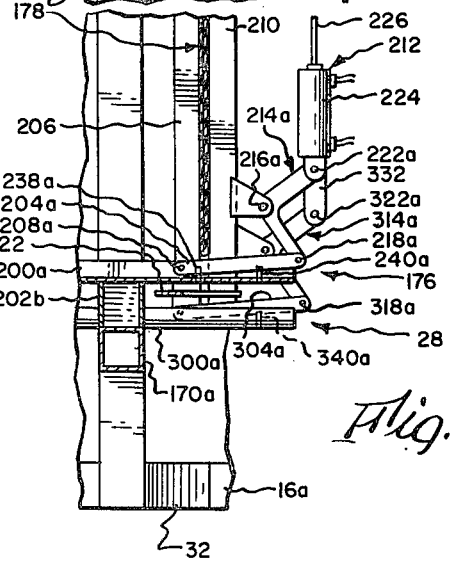
Fig. 3a.
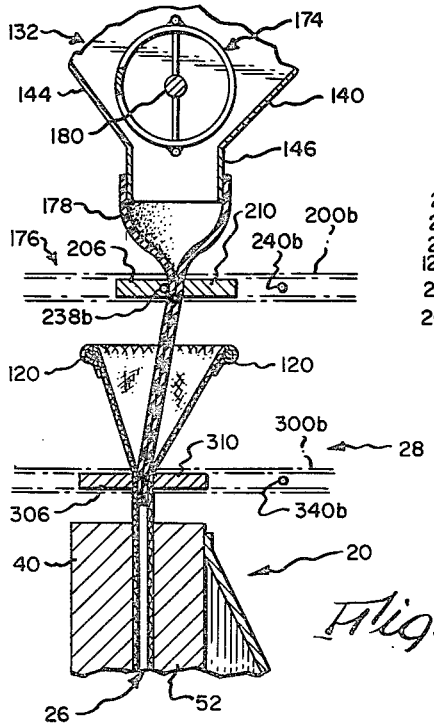
Fig. 5.

CHARGE FEEDING AND SLEEVE VALVE CONSTRUCTIONS FOR AUTOMATIC PLATEN PRESS

REFERENCE TO RELATED APPLICATION

This application is a continuation in part of my prior U.S. Pat. Application Ser. No. 036,062, filed May 4, 1979.

BACKGROUND OF THE INVENTION

In my prior U.S. Pat. application Ser. No. 036,062, there is disclosed an automatic platen press featuring the utilization of a vertically extending sleeve of filter cloth disposed intermediate a pair of cooperating press platens supported for movement horizontally relative to one another for squeezing of juice from a charge of fruit contained in the sleeve. An upper end of the sleeve is arranged in communication with a hopper or the like providing for batchwise charging of the sleeve with fruit to be pressed and upper and lower valve mechanisms are employed to selectively clamp off or close normally open upper and lower ends of the sleeve, as required to successively provide for filling of the sleeve with the charge of fruit to be pressed, retaining the charge of fruit within the sleeve during the pressing operation and permitting discharge of pressed fruit pulp in the form of a "cake" from which the juice has been extracted.

SUMMARY OF THE INVENTION

The present invention is directed towards improvements in a platen press of a type disclosed in my copending patent application Ser. No. 036,062, and more particularly to an improved hopper supply assembly and improved upper valve assembly adapted for use with such platen press.

More specifically, the hopper supply assembly of the present invention includes a supply hopper having an elongated generally rectangular discharge opening connected in flow communication with the upper end of a pressing sleeve by a flexible tube formed of a resiliently deformable material, and a distributing screw device rotatably supported within the hopper vertically above the discharge opening for providing for relatively uniform distribution of a charge of fruit to be pressed as same is discharged from the supply hopper for flow into the pressing sleeve. In alternate forms of the screw device having utilization in the present invention, there is provided opposite end conveyor sections, which tend to convey pulp to be pressed in opposite directions from adjacent a midportion of the outlet opening toward opposite ends thereof incident to rotation of the screw device in a given direction. In one form of the screw device, each conveyor section includes a spiral-like rod of circular convolution having an axially inner end connected to a drive axle of the screw device adjacent the mid point thereof and an axially outer end connected to such axle adjacent an outer end thereof in combination with a scraper bar fixed to the individual convolutions of the rod and disposed to extend in a spaced parallel relationship with the axle. In another form of the invention a spiral-like rod is formed with triangular convolutions, which avoid the necessity of providing the conveyor sections with scraper bars.

Further, the hopper supply assembly of the present invention includes an improved discharge control valve, which is mounted externally of the hopper and arranged to clamp off the flexible tube communicating with the pressing sleeve. The hopper supply assembly of the present invention constitutes a substantial improvement over that described in my prior application in that it is of relatively simple construction and permits discharge and pressing of pulp formed from apples last remaining in storage from a prior season. Apples of this type, although acceptable for purposes of producing juice, are of a consistency preventing simple gravity discharge of a measured charge to be pressed.

In accordance with the present invention, the upper valve assembly is structurally similar to the hopper discharge control valve with the exception that it is free to float horizontally as an incident to movement of the pressing sleeve during the pressing operation. Thus, the present valve assembly avoids stretching and/or twisting of the pressing sleeve, such as might otherwise shorten the useful life thereof.

DRAWINGS

The nature and mode of operation of the present invention will now be more fully described in the following detailed description taken with the accompanying drawings wherein.

Figure 1:
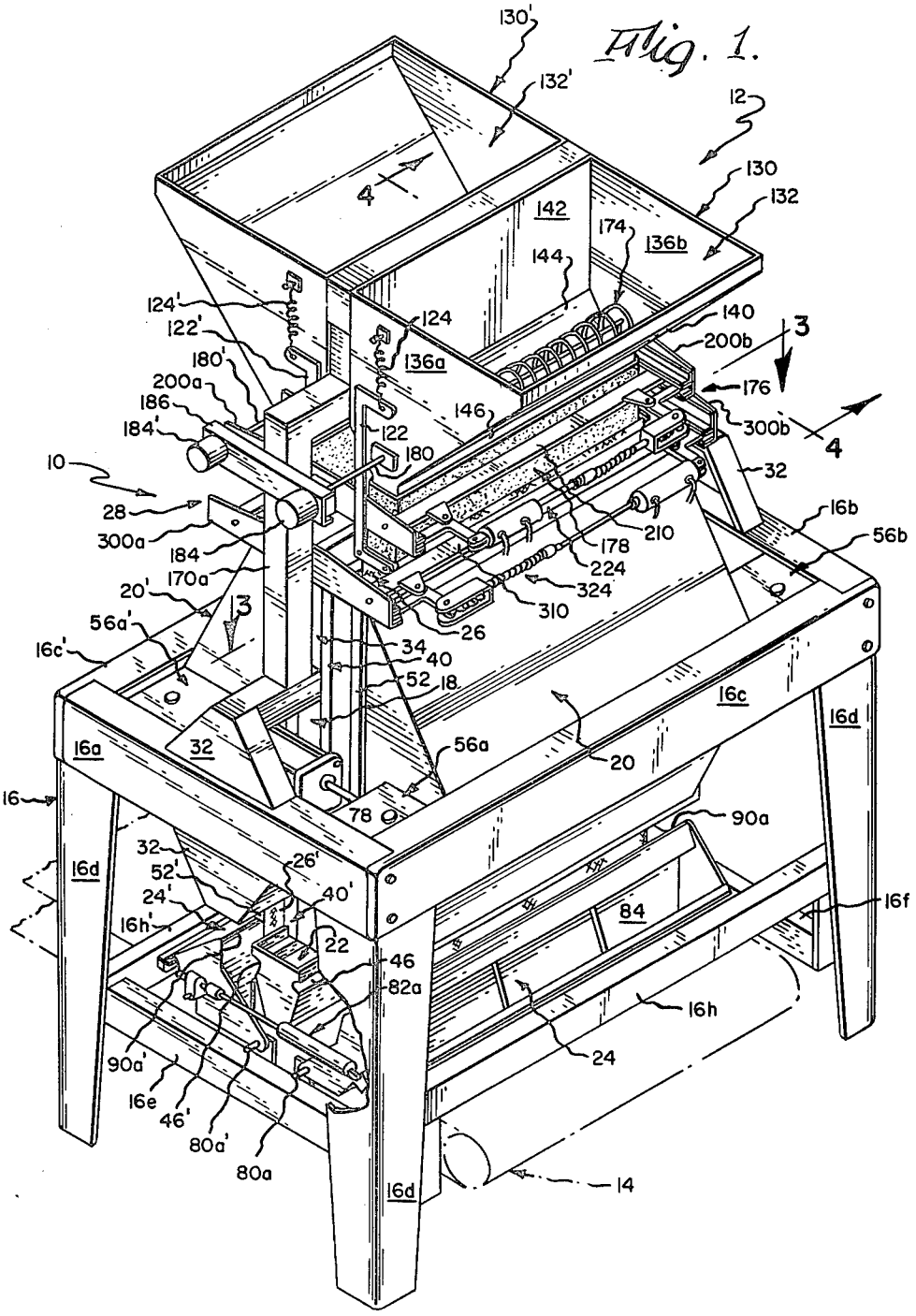
FIG. 1 is a perspective view of a press formed in accordance with the present invention.
Figures 2, 6, 7:
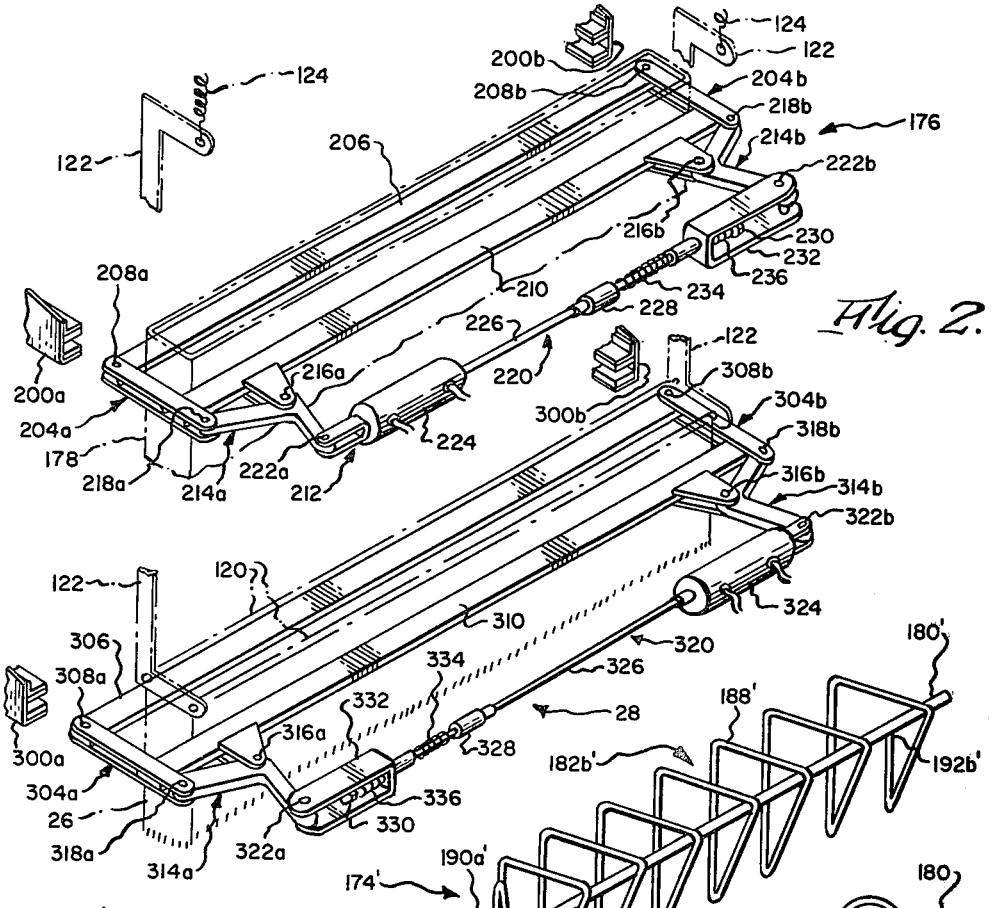
FIG. 2 is an exploded perspective view showing the hopper closing valve and the upper valve assembly.

FIGS. 3 and 3*a* are sectional views taken generally along the line 3–3 in FIG. 1;

FIG. 4 is a sectional view taken generally along the line 4–4 in FIG. 1;

FIG. 5 is a fragmentary view similar to FIG. 4 but showing the press platens in pressing position;

FIG. 6 is a perspective view of a distributing screw device for the supply hopper; and FIG. 7 is a perspective view illustrating an alternative construction of the distributing screw device.

DETAILED DESCRIPTION

Reference is first made to FIG. 1, wherein a platen press formed in accordance with the present invention is generally designated as 10 and shown in association with a fruit supply mechanism 12 and a pressed fruit pulp or "cake" discharge conveyor 14.

Press 10 is similar to that described in my copending application Ser. No. 036,062, filed May 4, 1979, in that it preferably includes a main framework 16; a stationary, double faced platen device 18; first and second movable, single faced platen devices 20 and 20'; a stationary juice collection trough device 22 arranged in association with platen device 18; first and second movable juice collection trough devices 24 and 24', which are arranged in association with platen devices 20 and 20', respectively; a pair of vertically extending, open ended sleeves 26 and 26', which are of generally rectangular cross-sectional design and fabricated from a suitable filter cloth, such as "cheese cloth"; and an upper valve mechanism 28. Aside from upper valve mechanism 28, which has been changed in accordance with the present invention, the structure and mode of operation of press 10 is essentially identical to that described in my above mentioned copending patent application, whose disclosure is incorporated herein by reference. However, to facilitate reference to the drawings and the detailed disclosure of the present invention, a brief description of the structure and mode of operation of press 10 will now be given, wherein parts comparable to those described in detail in my copending patent application are designated by like numerals.

Main framework 16 is shown in FIG. 1 as generally including a rectangular top frame member defined by front, rear and opposite side channel irons 16*a*, 16*b*, 16*c* and 16*c'*, respectively; angle iron leg or pedestal corner supports 16*d*; and front, rear and opposite side support braces 16*e*, 16*f*, 16*h* and 16*h'*, respectively. It will be understood that front and rear braces 16*e* and 16*f* serve to support opposite ends of trough devices 24 and 24' for pivotal movements about axes defined in part by pivot pins 80*a* and 80*a'* between their retracted cake discharge positions shown in FIG. 1 and operative/-pressing positions, not shown, wherein trough upper edges 90*a* and 90*a'* cooperate with clamping recesses 46 and 46' of trough device 22 to clamp off the lower ends of pressing sleeves 26 and 26', respectively. Pivotal movements of trough devices 24 and 24' between their above described positions may be affected by front and rear piston-cylinder devices, only the front one of which is shown and designated as 82*a* in FIG. 1.

Front and rear channel irons 16*a* and 16*b* serve to mount pairs of generally L-shaped flanges 32, which have their facing inner ends fixed to front and rear ends of a support assembly 34. Assembly 34 serves in turn to mount oppositely facing platen elements 40 and 40' of stationary platen device 18 and stationary trough device 22. Platen elements 40 and 40' are formed with parallel vertically extending slot recesses, not shown, having their lower ends disposed in flow communication with trough device 22.

Front and rear channel irons 16*a* and 16*b* also serve to support first and second platen devices 20 and 20' via identically constructed front and rear mounting assemblies shown in part at 56*a*, 56*b* and 56*a'* for horizontal movements towards and away from platen device 18 between their remote charging positions, shown in FIGS. 1 and 4 and adjacent pressing positions shown in part in FIG. 5, respectively. Movement of platen devices 20 and 20' may be controlled by front and rear piston-cylinder devices, only a front one of which is designated as 78 in FIG. 1. Further, it will be understood that platen devices 20 and 20' include platen elements 52 and 52', which are of mirror image construction and include a plurality of parallel, vertically extending slot recesses, not shown.

As in my prior construction, a lower quick disconnect mounting mechanism, not shown, serves to removably attach the lower ends of sleeves 26 and 26' to trough devices 24 and 24'. In a like manner, an upper quick disconnect mounting mechanism, which is shown in FIGS. 1, 4 and 5 in the case of sleeve 26 as including a pair of rods 120 and end plates 122, serves to suspend the upper ends of the sleeves from supply hopper mechanism 12 via springs 124 and 124'.

When press 10 is in its open or inoperative position depicted in FIGS. 1 and 4, the upper sleeve mounting mechanism serves to suspend sleeves 26 and 26' and cooperate with the lower sleeve mounting mechanism to maintain the sleeves in an expanded condition, wherein they assume relatively uniform, generally rectangular cross-sectional configurations throughout their vertical extent. When in their expanded condition, the sleeves would have a thickness, as measured normal to the platen elements, determined by known juice extraction considerations, and a width corresponding to or slightly less than the width or horizontal dimension of the faces of such platen elements.

Operation of press 10, as thus far described, is identical to that discussed in my above mentioned patent application in the following respects. Operation is commenced by placing fruit within hopper mechanism 12 to create charges of fruit having volumes corresponding essentially to or slightly less than the volumes of those portions of sleeves 26 and 26' disposed vertically coextensive with platen elements 40, 40', 52 and 52'. Prior to the discharge of such charges, piston-cylinder device 82*a* would be contracted to place first and second trough devices 24 and 24' in their operative positions in order to clamp off the lower end portions of sleeves 26 and 26' and to place their trough portions 84 and 84' in vertical alignment with their associated platen elements 52 and 52' when in both their charging and pressing positions. After placement of trough devices 24 and 24' in their operative positions, charges of fruit are discharged from mechanism 12 downwardly into sleeves 26 and 26', whereafter upper valve plate mechanism 28 is operated to clamp off sleeves 26 and 26' immediately above the platen elements in order to prevent "backflow" of pulp, during subsequent pressing thereof. Thereafter piston-cylinder devices 78 are contracted to move platen elements 52 and 52' towards their associated platen elements 40 and 40' in order to press charges of fruit confined by sleeves 26 and 26' intermediate their upper and lower "clamp-off points". Juice extracted from the charges of fruit, as a result of pressing thereof, flows through the compressed side surfaces of sleeve 26 and 26' and then downwardly through the slots provided in the faces of the platen elements for collection in stationary trough 22 and trough portions 84 and 84'. Trough portions 84 and 84' also serve to collect juice flowing directly through the unconstrained edges or dripping from sleeves 26 and 26'.

At the completion of the pressing operation, piston devices 78 are extended to return the platen elements 52 and 52' to their initial positions, whereafter the upper valve plate mechanism is opened and trough devices 24 and 24' returned to their initial positions. This serves to "open-up" the previously constricted upper and lower end portions of sleeves 26 and 26' and permit pulp previously compacted by pressure to assume relatively thin sheets or "cakes" to automatically separate from the inner surfaces of the sleeves and fall downwardly under the influence of gravity for collection by any suitable means, such as conveyor 14, and complete a cycle press operation.

In accordance with the present invention, framework 16 is modified by the provision of front and rear support posts 170*a* and 170*b*, which are arranged to extend from flanges 32 and serve to support supply mechanism 12 and upper valve mechanism 28.

As in the case of my prior construction, supply mechanism 12 includes a pair of hopper mechanisms 130 and 130' of mirror image construction, wherein mechanism 130 is shown in the drawings as including an upwardly opening hopper 132 bounded by parallel front and rear plates 135*a* and 136*b*; a downwardly and inwardly inclined outer plate 140; and a composite inner plate having upper and lower portions 142 and 144; and a rectangular discharge duct or fixture 146, which is joined to the lower marginal edges of plates 136*a*, 136*b*, 140 and 144 to define a discharge opening or outlet for hopper 132. However, mechanism 12 departs from my prior construction in that hopper mechanism 130 includes a distributing screw device 174; a discharge valve mechanism 176 mounted exteriorly of hopper 132; and a duct 178 formed of resiliently deformable material and having its upper end suitably fixed to discharge duct 146 and its lower end telescopically received within the upper end of sleeve 26.

Screw device 174 includes an axle 180, which is journaled adjacent its opposite ends by suitable bearing devices carried by front and rear hopper walls 136*a* and 136*b* and serves to mount a pair of conveyor sections 182*a* and 182*b;* and a suitable axle drive motor 184 mounted on support post 170*a,* as by a suitable bracket 186. Conveyor sections 182*a* and 182*b* are of mirror image construction and configured to conveyor material disposed in hopper 132 adjacent its discharge outlet in opposite directions from adjacent a mid-point of discharge duct 146 or hopper outlet, when axle 180 is rotated in a counter-clockwise direction, as viewed in FIG. 6. Conveyor sections 182*a* and 182*b* include spiral-like rods 188*a* and 188*b,* which have their inner ends 190*a* and 190*b* fixed to axle 180 adjacent a mid portion thereof, as measured between the hopper front and rear walls, and their outer ends 192*a* and 192*b* fixed to the axle adjacent its end portions, that is, portions of the axle disposed adjacent the inner surfaces of such walls.

In a presently preferred construction best shown in FIG. 6, rods 188*a* and 188*b* are defined by circular convolution elements, which are disposed concentrically of axle 180, and the conveyor sections additionally include straight bars or rods 194*a* and 194*b,* which are disposed in a spaced parallel relationship with axle 180 and fixed, as by welding to the individual convolutions of their associated convolution elements.

In an alternative construction shown in FIG. 7, where primed numbers are employed to identify like parts, spiral-like rods 188*a'* and 188*b'* are in the form of triangular convolution elements. As viewed on end, such elements appear as equilateral triangles whose centers are intersected by the axis of axle 180'.

Screw devices 174 were developed after tests revealed that, unlike charges prepared from relatively fresh apples, charges prepared from apples subject to a prolonged storage on the order of about one year do not readily flow downwardly through hopper 132 for discharge through duct 146 under the influence of gravity. Specifically, it was found that such charges tend to create a "bridge" between hopper walls 140 and 144 immediately adjacent the discharge outlet with the "bridging" condition being most serious adjacent hopper walls 136*a* and 136*b,* thereby resulting in non-uniform filling of sleeves 26 and 26'. Screw device 174 has been found to be effective in preventing "bridging" of a charge and to provide for uniform distribution of the charge passing through the discharge opening of hopper 132. In operation, circular convolution elements 188*a* and 188*b* tend to provide for uniform distribution of a charge lengthwise the discharge outlet, while their "open" constructions present a minimum of interference with downwardly flow of charge towards such outlet. In this construction, bars 194*a* and 194*b* function as "scraper" elements, which tend to loosen lower or "bridging" portions of the charge to facilitate flow thereof downwardly through the convolution elements and proper distribution thereof lengthwise of the outlet opening.

In the alternative construction described above in reference to FIG. 7, the junctions of the legs or "corners" of the triangular convolutions 188*a'* and 188*b'* serve the same function as bars 194*a* and 194*b,* such as avoids the necessity of providing these additional parts. However, as compared to the preferred construction, the construction of FIG. 7 would appear to be more difficult to fabricate.

Discharge valve mechanism 176 is best shown in FIGS. 2–5 as comprising a pair of parallel, generally U-shaped and facing guide tracks 200*a* and 200*b,* which are suitably fixed, as by spacer brackets 202*a* and 202*b,* to posts 170*a* and 170*b,* respectively; a pair of composite slide plates 204*a* and 204*b,* which are slidably supported by guide tracks 200*a* and 200*b,* respectively; inner clamping bar or plate 206, which has its opposite ends supported by inner ends of the slide plates via pivot pins 208*a* and 208*b;* an outer clamping bar or plate 210, which has its opposite ends slidably supported within the slide plates; and an operating mechanism 212. Mechanism 212 includes a pair of L-shaped actuator arms 214*a* and 214*b* having mid portions connected to opposite ends of outer clamping bar 210 by pivot pins 216*a* and 216*b,* first arm portions connected to outer ends of slide plates 204*a* and 204*b* by pivot pins 218*a* and 218*b,* and second arm portions connected to opposite ends of a push-pull linkage 220 by pivot pins 222*a* and 222*b.* Linkage 220 includes a fluid operated piston-cylinder device 224 having a piston rod 226 fitted with a stop collar 228 and a threaded adjustment nut 230; a U-shaped connector bracket 232 slidably supporting piston rod 226 intermediate collar 228 and not 230; a first, relatively light compression spring 234 disposed concentrically of piston rod 226 intermediate collar 228 and bracket 232; and a second, relatively heavy compression spring 236 disposed concentrically of piston rod 226 intermediate nut 230 and bracket 232.

By referring to FIGS. 3, 3*a* and 5, it will be understood that guide tracks 200*a* and 200*b* are provided with inner stop devices or pins 238*a* and 238*b,* which are freely received with slide plates 204*a* and 204*b* intermediate inner and outer clamping bars 206 and 210 and outer stop devices or pins 240*a* and 240*b,* which are freely received within the slide plates intermediate outer clamping bar 210 and the first arm portions of actuator arms 214*a* and 214*b.*

In operation, extensions and retractions of piston rod 226 serve to place clamping bars 206 and 210 alternately in their open or inoperative and closed or clamping positions, shown in FIGS. 2, 3 and 4 and FIGS. 3*a* and 5, respectively. In open position, which is determined by engagement of outer clamping bar 210 and/or the first arm portions of actuator arms 214*a* and 214*b* with pins 240*a* and 240*b,* as best shown in FIG. 3, the relatively inner or facing edges of bars 206 and 210 are essentially disposed in vertical alignment with the side walls of duct 146 and in proximity to or non-deforming engagement with duct 178, as best shown in FIG. 4. Further, in open position, spring 234 is in a slightly compressed state.

Incident to retraction of piston rod 226 to place bars 206 and 210 in their clamping position, wherein they cooperate to deform and effectively clamp off duct 178, as best shown in FIGS. 3*a* and 5, actuator arms 214*a* and 214*b* are caused to rotate through approximately 90° and thereby cause slide plates 204*a* and 204*b* to move relatively outwardly within the guide tracks 200*a* and 200*b* (as well as to undergo pivotal movements about the axes of pivot pins 208*a* and 208*b*) and bar 210 to move relatively inwardly within the slide plates towards bar 206.

In the clamping position of the clamping bars 206 and 210, which is defined by engagement of bar 206 with pins 238*a* and 238*b*, as shown in FIGS. 3*a* and 5, the inner edges of the bars are disposed immediately adjacent opposite sides of a plane vertically bisecting duct 146. Further, in clamping position, spring 236 is in a compressed state. As will be apparent, springs 234 and 236 provide for a lost motion connection between the piston cylinder device 224 and the clamping bars, while adjustment nut 230 affords means for selectively varying the clamping force exerted by the clamping bars on duct 178.

Further, in accordance with the present invention, upper valve mechanism 28 of my prior construction is replaced by that best shown in FIG. 2 as having a construction and mode of operation essentially identical to that of above described discharge valve mechanism 176. Accordingly, parts of mechanism 28, which structurally and functionally correspond to those of mechanism 176, are designated by like numbers, but of the three hundred series.

Mechanism 28 departs from mechanism 176 in that its guide tracks 300*a* and 300*b* are fixed directly to posts 170*a* and 170*b*, such that these guide tracks are spaced forwardly and rearwardly of guide tracks 200*a* and 200*b*, respectively, to accommodate end plates 122, 122, as best shown in FIGS. 1, 3 and 3*a*. Further, it will be noted by reference to FIGS. 3, 3*a* and 5 that mechanism 28 does not utilize stop pins comparable to pins 238*a* and 238*b*, which are arranged to engage with inner clamping bar 306 for the purpose of defining the clamping position of bars 306 and 310. Rather, upon contraction of piston-cylinder device 324, bars 306 and 310 are free to initially move from their open position shown in FIG. 3 relatively towards one another into their closed position shown in FIG. 3*a* in which they are more or less disposed in vertical alignment with bars 206 and 210, and subsequently move or "float" to the left, as viewed in FIG. 5, so as to follow sleeve 26 as it is compressed between platen elements 40 and 52. Upon retraction of platen element 52 at the completion of the pressing operation, the weight of sleeve 26 and its enclosed "cake" tends to return the sleeve and thus clamping bars 306 and 310 to their initial closed position shown in FIG. 3*a*. Thereafter, when piston-cylinder device 324 is extended, the clamping bars tend to return to their open position shown in FIG. 3, which is determined by engagement of clamping bar 310 and/or arms 314*a*, 314*b* with stop pins 340*a*, 340*b*. As in the case of my prior valve mechanism, the return of present mechanism 28 to its nonclamping condition, permits opening of the upper end of sleeve 26 to facilitate "cake" discharge and permit subsequent filling of the sleeve with a new charge of fruit to be pressed.

The present construction of mechanism 28 and the provision of springs 124, 124 to permit movements of end plates 122, 122 and thus the upper end of sleeve 26, results in the upper portion of the sleeve being subjected to little or no stretching and twisting, as an incident to its being clamped off and subsequently compressed, such as might otherwise tend to shorten its useful life.

In FIG. 5, duct 178 is shown as extending downwardly within sleeve 36 to a point below the level of clamping bars 306 and 310, such that its lower end terminates immediately above the platen elements and is clamped off incident to the clamping off of the upper end of sleeve 26. The illustrated construction is preferred in that it serves to minimize escape/loss of juice from that portion of sleeve 26 disposed above the platen elements. In that duct 178 is formed of a resiliently deformable material, the slight degree to which it is stretched incident to the above described "floating" movement of bars 306 and 310 does not appear to have any detrimental effect. However, if desired, duct 178 may terminate at a point slightly above the level of clamping bars 306 and 310.

While the presently preferred form of the invention is illustrated in FIG. 1, it is contemplated that a press may be designed for a low volume installation characterized in that only a pair of relatively movable platen devices are provided in association with a single sleeve. Also, it is contemplated that the press of the present invention may be used with a charge supply mechanism other than the preferred form thereof illustrated in the drawings. Moreover, it is contemplated that upper valve mechanism 28 provided in the preferred press construction may be dispensed with in certain instances, such as by way of example, when the supply mechanism is disposed in immediate proximity to the platens thereby permitting its outlet control valve to perform a dual function, and time considerations do not require that the charge forming operation proceed during the pressing operation.

The hydraulic and electrical control circuits required to provide for sequential operation of the above mentioned piston-cylinder devices and/or for sensing of the level of fruit deposited in hoppers 134 and 134' for charge forming purposes may be conventional in all respects and thus form no part of the present invention.

What is claimed is:

1. A press particularly adapted for use in extracting juice from fruit, said press comprising in combination:

a pair of vertically disposed press platens including a stationary platen element and a movable platen element supported for horizontal movement relative to said stationary platen element between remote charging and adjacent pressing positions;

a sleeve formed of filter cloth;

means to movably suspend said sleeve to extend vertically and horizontally intermediate said platen elements, said sleeve having open upper and lower ends and side surfaces disposed for pressing engagement by said platen elements;

means for depositing a charge of fruit to be pressed within said sleeve through said upper end;

means for selectively closing said sleeve adjacent said lower end;

means for selectively closing said sleeve adjacent said upper end including a pair of horizontally disposed clamping bars arranged adjacent said side surfaces of said sleeve, means for supporting said clamping bars for movement relative to said sleeve from an open position in which said clamping bars are disposed adjacent said side surfaces and a clamping position in which said clamping bars are disposed in deforming engagement with said side surfaces for clamping off and closing said sleeve, and means for moving said clamping bars between said open and closed positions, said means for supporting said clamping bars additionally permitting horizontal movements thereof while in deforming engagement with said sleeve as an incident to horizontal movements of said sleeve resulting from movements of said movable platen element between said charging and pressing positions, said means for closing said lower and upper ends of said sleeve cooperating to retain said charge of fruit within said sleeve during pressing thereof incident to movement of said movable platen element into said adjacent pressing position; and means for collecting juice extracted from said charge of fruit disposed within said sleeve incident to pressing thereof.

2. A press according to claim 1, wherein said means for depositing a charge of fruit includes a hopper having a downwardly opening discharge outlet of elongated, generally rectangular configuration; a vertically extending duct having a generally rectangular cross-sectional configuration and being formed of a resiliently deformable material, said duct having its upper end fixed to said hopper for flow communication with said discharge outlet and its lower end telescopically received within said upper end of said sleeve; means for selectively clamping off and closing said duct intermediate said hopper and said upper end of said sleeve; an axially elongated distributing device rotatably supported within said hopper to extend horizontally lengthwise of and in proximity to said discharge outlet, said distributing device having opposite end conveyor sections tending to convey material within said hopper in opposite directions from adjacent a mid-portion of said discharge outlet towards opposite ends thereof incident to rotation of said distributing device in a given direction while permitting movement of material downwardly through said conveyor sections towards said discharge outlet; and drive means for rotating said distributing device in said given direction.

3. A press according to claim 2, wherein said means for clamping off said duct includes a pair of parallel guide tracks disposed outwardly of opposite vertically disposed edge surfaces of said duct and to extend normal to vertically disposed side surfaces thereof, first and second clamping bars disposed one for clamping engagement with each of said side surfaces of said duct, a pair of slide plates supported one by each of said guide tracks for movements lengthwise thereof, said first of said clamping bars having its opposite ends pivotally connected to first ends of each of said slide plates, said second of said clamping bars having its opposite ends slidably supported by said slide plates intermediate said first of said clamping bars and second ends of said slide plates; a push-pull linkage including a fluid operated piston-cylinder device; and a pair of generally L-shaped actuator arms having mid-portions pivotally connected to said second of said clamping bars adjacent said opposite ends thereof, first end portions pivotally connected to said second ends of said slide plates, and second end portions pivotally connected to opposite ends of said linkage, whereby extensions and contractions of said linkage serve to move said first and second clamping bars relative to one another between open and closing positions, respectively, said first and second clamping bars when in open position being arranged adjacent said side surfaces of said duct and when in clamping position being in deforming engagement with said side surfaces for clamping off said duct.

4. A press particularly adapted for use in extracting juice from fruit, said press comprising in combination:

a pair of vertically disposed press platens including a stationary platen element and a movable platen element supported for horizontal movement relative to said stationary platen element between remote charging and adjacent pressing positions;

a sleeve formed of filter cloth;

means for movably suspending said sleeve to extend vertically and horizontally intermediate said platen elements, said sleeve having open upper and lower ends, vertically extending edge surfaces and vertically extending side surfaces, said side surfaces being disposed for pressing engagement by said platen elements;

means for depositing a charge of fruit to be pressed within said sleeve through said upper end;

lower valve means for selectively closing said sleeve adjacent said lower end;

upper valve means for selectively closing said sleeve adjacent said upper end, said upper valve means including a pair of parallel guide tracks disposed outwardly of said edge surfaces and to extend normal to said side surfaces, first and second clamping bars disposed one for clamping engagement with each of said side surfaces, a pair of slide plates supported one by each of said guide tracks for movements lengthwise thereof, said first of said clamping bars having its opposite ends pivotally connected to first ends of each of said slide plates, said second of said clamping bars having its opposite ends slidably supported by said slide plates intermediate said first of said clamping bars and second ends of said slide plates, a push-pull linkage including a fluid operated piston-cylinder device, and a pair of generally L-shaped actuator arms having mid-portions pivotally connected to said second of said clamping bars adjacent said opposite ends thereof, first end portions pivotally connected to said second ends of said slide plates and second end portions pivotally connected to opposite ends of said linkage, whereby extensions and contractions of said linkage serve to move said clamping bars relative to one another between open and closing positions, respectively; said clamping bars when in open position being disposed adjacent said side surfaces and when in clamping position being disposed in deforming engagement with said side surfaces for clamping off and closing said sleeve adjacent said upper end thereof, said upper and lower means cooperating to retain said charge of fruit within said sleeve during pressing thereof incident to movement of said movable platen element into said adjacent pressing position; and means for collecting juice extracted from said charge of fruit disposed within said sleeve incident to pressing thereof.

5. A press according to claim 4, wherein said guide tracks carry stop devices, said stop devices being arranged for engagement with said second of said clamping bars and/or said first end portions of actuator arms for determining said open position.

6. A press according to claim 4, wherein said means for depositing a charge of fruit includes a vertically extending duct formed of resiliently deformable material, said duct having an open lower end thereof telescopically received within said upper end of said sleeve and terminating at a point disposed vertically intermediate said clamping bars and said platen elements.

7. A press according to claims 4 or 5, wherein said push-pull linkage includes first and second spring means for providing lost motion connection between said piston-cylinder device and said second end portions of said actuator arms during extensions and contractions of said linkage, respectively, and means are provided to adjust said second spring means for adjustably controlling clamping force applied to said sleeve by said clamping bars when in said clamping position.

8. A mechanism according to claim 3, wherein said guide tracks each carry first and second stop devices, said first of stop devices being arranged for engagement with said first of said clamping bars for determining said clamping position and said second of said stop devices being arranged for engagement with said second of said clamping bars and/or said first end portions of said actuator arms for determining said open position.

9. A press according to claim 4, wherein said means for depositing a charge of fruit includes a hopper having a downwardly opening discharge outlet of elongated, generally rectangular configuration; a verticaly extending duct having a generally rectangular cross-sectional configuration and being formed of a resiliently deformable material, said duct having its upper end fixed to said hopper for flow communication with said discharge outlet and its lower end telescopically received within said upper end of said end of said sleeve; means for selectively clamping off and closing said duct intermediate said hopper and said upper end of said sleeve; and a distributing device supported within said hopper for controlling flow of material in said hopper downwardly through said discharge outlet; and said means for clamping off said duct includes a second pair of parallel guide tracks disposed outwardly of opposite vertically disposed edge surfaces of said duct and to extend normal to vertically disposed side surfaces thereof, a second pair of first and second clamping bars disposed one for clamping engagement with each of said side surfaces of said duct, a second pair of slide plates supported one by each of said guide tracks of said second pair for movements lengthwise thereof, said first of said clamping bars of said second pair having its opposite ends pivotally connected to first ends of each of said slide plates of said second pair, said second of said clamping bars of said second pair having its opposite ends slidably supported by said slide plates of said second pair intermediate said first of said clamping bars of said second pair and second ends of said slide plates of said second pair, a second push-pull linkage including a second fluid operated piston-cylinder device, and a second pair of generally L-shaped actuator arms having mid-portions pivotally connected to said second of said clamping bars of said second pair adjacent said opposite ends thereof, first end portions pivotally connected to said second ends of said slide plates of said second pair, and second end portions pivotally connected to opposite ends of said second linkage, whereby extensions and contractions of said second linkage serve to move said first and second clamping bars of said second pair relative to one another between open and closing positions, respectively, said first and second clamping bars of said second pair when in open position thereof being arranged adjacent said side surfaces of said duct and when in clamping position thereof being in deforming engagement with said side surfaces of said duct for clamping off said duct.

10. A press according to claim 9, wherein said guide tracts of said second pair each carry first and second stop devices, said first of said stop devices being arranged for engagement with said first of said clamping bars of said second pair for determining said clamping position thereof and said second of said stop devices being arranged for engagement with said second of said clamping bars of said second pair and/or said first end portions of said second pair of actuator arms for determining said open position thereof.

* * * * *